US006896274B2

(12) United States Patent
Leslie

(10) Patent No.: US 6,896,274 B2
(45) Date of Patent: May 24, 2005

(54) RAMP BOARD

(76) Inventor: David Garrett Leslie, 1638 West 41st Avenue, Vancouver, British Columbia (CA), V6M 1X8

( * ) Notice: Subject to any disclaimer, the term of this patent is extended or adjusted under 35 U.S.C. 154(b) by 76 days.

(21) Appl. No.: 10/284,277

(22) Filed: Oct. 31, 2002

(65) Prior Publication Data

US 2003/0155734 A1 Aug. 21, 2003

Related U.S. Application Data

(60) Provisional application No. 60/358,248, filed on Feb. 21, 2002.

(51) Int. Cl.[7] ..... B62M 1/00; A63C 11/00

(52) U.S. Cl. ..... 280/87.042; 280/809; D21/765

(58) Field of Search ..... 280/87.042, 87.01, 280/87.021, 87.041, 87.05, 809, 842; 180/180, 181; D21/765

(56) References Cited

U.S. PATENT DOCUMENTS

| | | | | | |
|---|---|---|---|---|---|
| D242,735 | S | * | 12/1976 | Candler | D21/765 |
| D252,346 | S | * | 7/1979 | Solheim | D21/765 |
| D252,347 | S | * | 7/1979 | Solheim | D21/765 |
| 4,295,656 | A | * | 10/1981 | Moore | 280/87.042 |
| 5,029,661 | A | * | 7/1991 | Wallace et al. | 180/165 |
| 5,096,225 | A | * | 3/1992 | Osawa | 280/842 |
| 5,154,436 | A | * | 10/1992 | Jez et al. | 280/87.042 |
| D338,253 | S | * | 8/1993 | Smith et al. | D21/765 |
| 5,458,351 | A | * | 10/1995 | Yu | 280/87.042 |
| D365,377 | S | * | 12/1995 | Chen | D21/765 |
| 5,544,919 | A | * | 8/1996 | Tinkler | 280/809 |
| 5,716,562 | A | * | 2/1998 | Peart et al. | 264/45.3 |
| 5,855,385 | A | * | 1/1999 | Hambsch | 280/87.042 |
| D413,954 | S | * | 9/1999 | Gerlach | D21/765 |
| 5,997,018 | A | * | 12/1999 | Lee | 280/87.042 |
| D422,662 | S | * | 4/2000 | Edwards et al. | D21/765 |
| 6,254,113 | B1 | * | 7/2001 | Dornan | 280/87.042 |
| 6,568,695 | B2 | * | 5/2003 | Dornan | 280/87.042 |
| D478,643 | S | * | 8/2003 | Langford et al. | D21/765 |
| 6,698,776 | B2 | * | 3/2004 | Todd | 280/87.042 |

FOREIGN PATENT DOCUMENTS

| | | | | |
|---|---|---|---|---|
| DE | 1075477 | * | 7/1957 | 280/842 |

OTHER PUBLICATIONS

HAE Streetluge Construction Guidelines. www.skateluge.com/stguide, (2000, by HAE Inc.) Printed Aug. 12, 2002, 5 pages.

* cited by examiner

*Primary Examiner*—Christopher P. Ellis
*Assistant Examiner*—Gerald B. Klebe
(74) *Attorney, Agent, or Firm*—Vermette & Co.; Clifford W. Vermette

(57) ABSTRACT

A skateboard having a deck with an arched center, two bumper regions, one at either end of the deck, each of the bumper regions extending above and rigidly affixed to the deck. Truck and wheel assemblies mounted beneath respective ones of the bumper regions.

10 Claims, 3 Drawing Sheets

PRIOR ART

RAMP BOARD

RELATED APPLICATIONS

The present application is related to and claims the priority benefits of a provisional patent application filed in the U.S. Patent and Trademark Office on Feb. 21, 2002 under Ser. No. 60/358,248.

FIELD

The present invention relates to a skateboard, which responds on a hard surface to a user's actions much as does a snowboard on a snow surface.

BACKGROUND

A conventional skateboard consists of a rigid board with a pair of trucks" bolted to the underside of the board at either end. A pair of wheels are journalled to axles which are mounted to each truck. There are two pivot points on each truck one of which is elevated relative to the other and further forward. When the board is tipped the wheels rotate relative to the board when weight is applied along one edge of the board, with the front wheels rotating in the direction of the turn and the rear wheels rotating in the opposite direction. A phenomenon known as wobbling can occur at high speeds when a turn is attempted and a loss of control and stability of the board is experienced. A rider typically applies pressure to an opposite side to correct the turn only to find he has overcorrected. A further correction on the opposite side followed by other corrections results in the rider eventually falling. Additionally, such skateboards have tended to be somewhat rigid and non-shock absorbing.

Skateboarding, like snowboarding, conducts routines in a hollow cylindrical surface called a half-pipe which is a U-shaped wood structure with two walls that are 10 to 15 feet high, forty feet long, with a ten-foot horizontal section connecting them. Rails at the top of the walls are made of plastic piping. A skateboarder uses the rails to perform rail-slide tricks such as by rolling up one side at an angle, turning the board sideways across the rail, sliding, and then re-entering into the half-pipe. Another trick is for the rider to launch himself into the air, turning the board to a vertical position, landing with the nose on the rail, holding that position, and then re-entering into the half-pipe. It is important when performing such tricks for a rider to feel a reasonable level of rigidity in the skateboard, good balance while performing tricks, a reduction in speed oscillations, a means of sliding the trucks over the rail and back into the pipe and an elimination of the need to hold the board while in the air.

SUMMARY OF THE INVENTION

According to the invention there is provided a skateboard having an arch along its length, the arch having sufficient curvature to provide a spring-like response and having a center elevated more than its ends. At either end of the deck there is a bumber extending above and rigidly affixed to said deck. Truck and wheel assemblies are mounted beneath respective ones of bumbers.

Foot supports may be formed on top of the deck inside of the bumper regions, such that a distance between the wheels is greater than a distance between the foot supports;

Advantageously, the foot supports are at a level below a pivot of said trucks.

Preferably, the skateboard may have a pair of bindings, one pair for each one of the foot supports. The foot supports may be flat.

The skateboard may include a bottom frame support below the deck having a bottom profile which when extended is below an axis of the wheels. This prevents the trucks from catching on the rail during a rail slide. Preferably, the bottom frame has a U-shape.

The bumpers regions each may have a vertical section which extends above the deck and a horizontal section which extends outwardly from and substantially perpendicular to the vertical section.

The arched deck not only provides increased strength, but also provides a softer landing, improved launching capabilities and extends below the bottom of the trucks to protect them from becoming hung up on the rail when re-entering after a trick. One further advantage of the arch is the profile of the underside near the trucks which protects the trucks from getting caught up on the rail and allows the underside of the skateboard to slide over the rail.

The foot supports formed on top of the deck adjacent to the bumper regions have bindings. Preferably, the foot supports are below a level of the trucks' pivot point.

BRIEF DESCRIPTION OF THE DRAWINGS

Further features and advantages will be apparent from the following detailed description, given by way of example, of a preferred embodiment taken in conjunction with the accompanying drawings, wherein.

DETAILED DESCRIPTION WITH REFERENCE TO THE DRAWINGS

Figure 1:
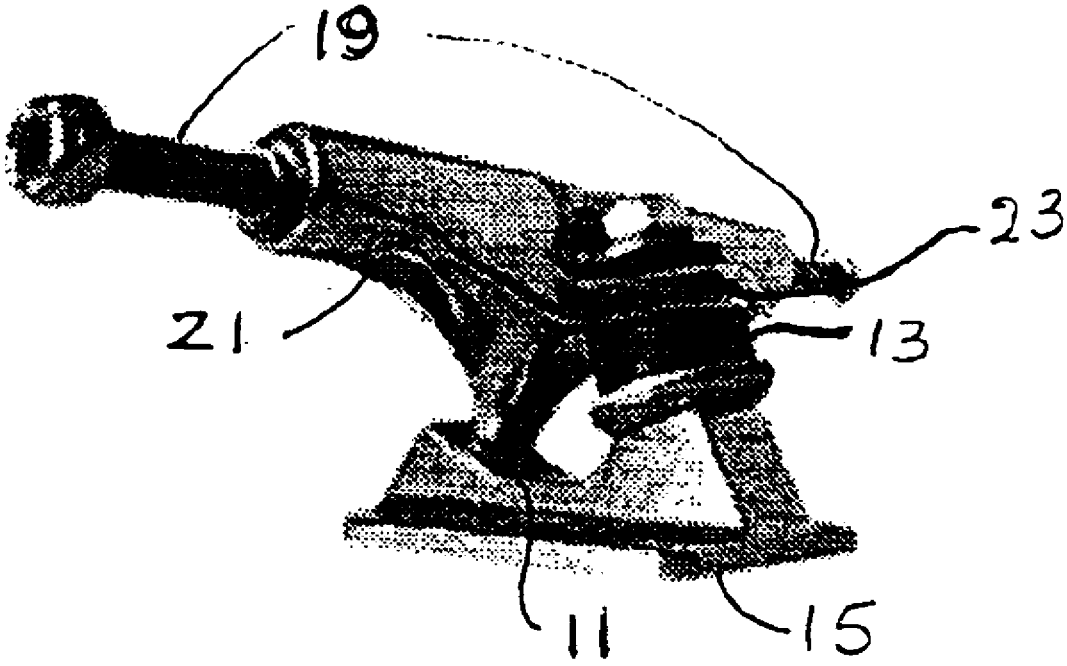
FIG. 1 is a perspective view of a known truck for a skateboard.
Figure 2:
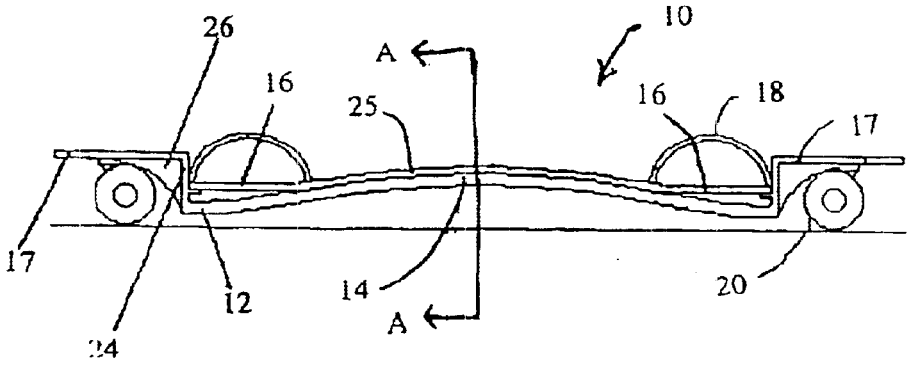
FIG. 2 is a side elevation view of the skateboard.
Figure 5:
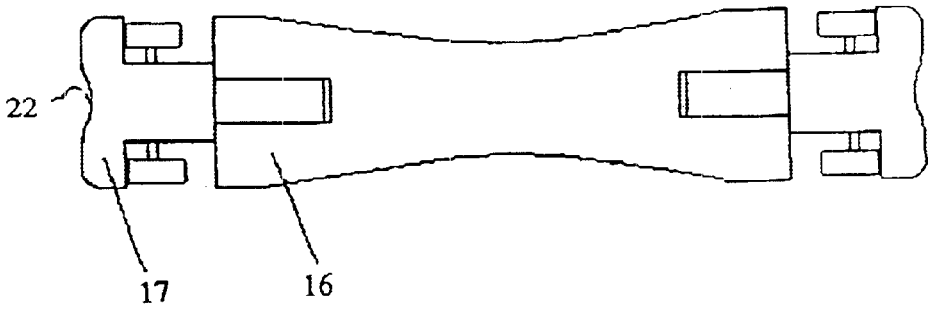
FIG. 5 is a top view of the skateboard.
Figure 3:
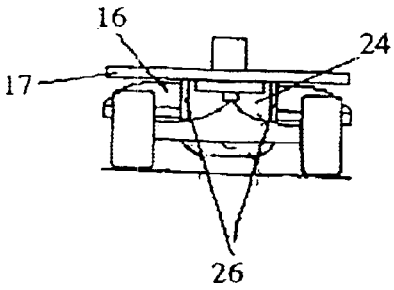
FIG. 3 is a front elevation view of the skateboard.
Figure 4:
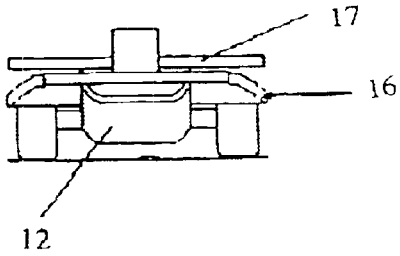
FIG. 4 is a view along line A—A shown in FIG. 1.

Referring to FIG. 1 there is shown a known truck for a skateboard. The truck has a base plate 15, which is screwed to the underside of the skateboard and axles 19 to which wheels (not shown) are attached. A rear pivot point 11 allows tipping of the truck housing 21 relative to the base plate 15. An elastomeric bushing 13 allows tipping of the front portion 23 of the truck housing 21 relative to the base plate 15. However, the difference in elevation of pivot 11 and front portion 23 combined with the difference in position perpendicular to the axles causes the axles to rotate when the skateboard is tipped. Tipping the base plate 15 counterclockwise when viewed from the front where the elastomeric bushing 13 is located causes the front portion 23 to move to the left and the pivot 11 which moves a lesser amount to the left than the front portion 23 to move clockwise around the elastomeric bushing 13 when viewed from top in FIG. 1. As a result the axes 19 and hence the wheels attached thereto rotate clockwise as well. Reversing the rear truck (not shown) results in both wheels counter rotating and a turn being effected in the direction of tipping.

Referring to FIGS. 2 to 5, the skateboard 10, consists of a bottom frame support 12 having an arched section 14, U-shaped in cross-section, in the middle region and underlying two flat foot supports 16 at either end and extending from deck 25. Foot bindings 18 are located at the foot supports 16 for use in retaining a user's feet during operation. A T-shaped bumper 17 is located at both ends and is integral with the frame 12 but has a vertical portion 24 which raises the horizontal portion of bumper 17 above the foot supports 16. Truck and wheel assemblies 20 are mounted beneath the bumpers 17. Gussets 26 support the bumpers 17, which, in turn, support the truck and wheel assemblies 20. A central recess 22 is formed in the outwardly projecting portion of the horizontal portion of bumper 17.

The arched section 14 provides not only bending strength but also allows a rider the means for sliding the truck and wheel assembly 20 over the rail of a half-pipe without the truck catching the rail. A half-pipe is a forty foot long wooden structure with two walls that are each 10 to 15 feet high, with a ten foot horizontal connecting section. Skateboard users go from side to side pushing off the ramp surface into the air often above the walls and return near or at the top of the walls and then roll towards the opposite side. The arched section 14 provides a user with a spring like response when pushing off the ramp surface, thereby enhancing the takeoff and with a greater capacity to absorb impact on landings.

The flat foot supports 16 provide rigidity and by positioning the rider's feet at an elevation below the pivot point of the trucks, the amount of speed oscillations is considerably reduced.

Figure 6:
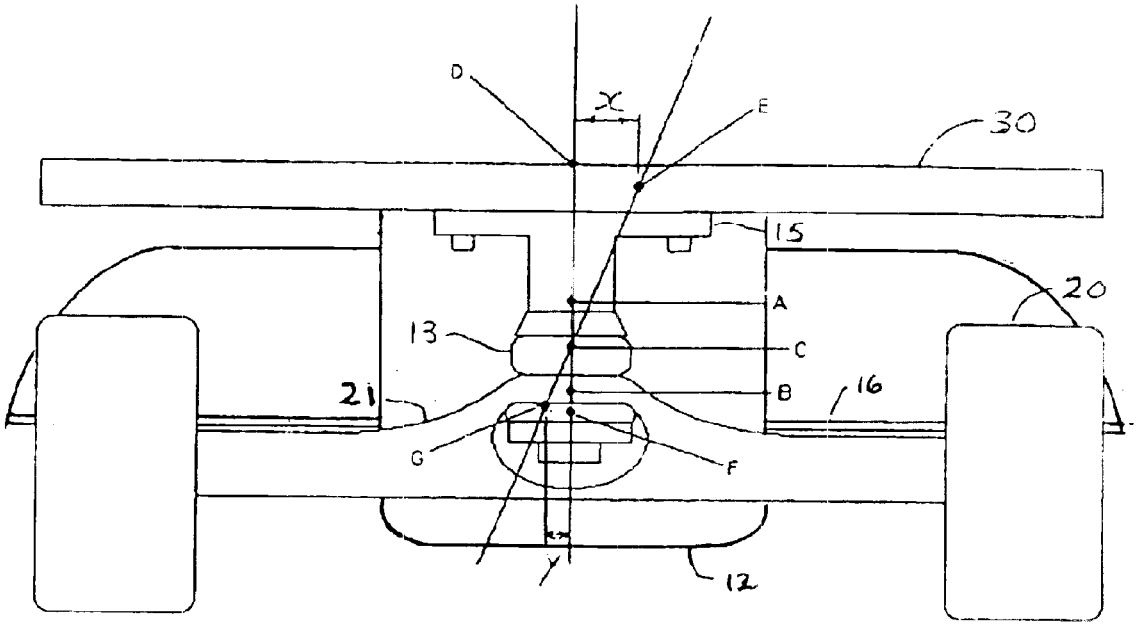
FIG. 6 is a front elevation view of the truck and wheels attached to a skateboard showing movement of the various points on tipping.

Referring to FIG. 6 there is shown a truck with a line of action passing through the points A and B corresponding to the pivot point 11 and the front portion 23. The line passing through point D corresponding to an upper surface 30 of the skateboard, rotates to point E when the top of the skateboard is tipped. In this case with a user's feet placed on top of the skateboard 30, the moment arm of the point where the user's weight is applied vertically, through E is 'x'. With the user's feet on the ramp board at point F, upon rotation, the rider's feet actually rise up somewhat in going to point G and are characterized by a moment arm 'y' much smaller than 'x'.

When pressure is placed on one side of a traditional flat board, the line of action extends from the surface of the board D down through the center of the truck C, to the support surface. When the surface of the skateboard tips, depending on the angle of tipping, the skateboard could become unstable and tip over. Where the rider's feet are initially positioned at point D, the tipping moment or torque line in FIG. 6 is given by the product of 'x' and the weight of the rider, where the line through E and C represents the angle of tipping as measured from the vertical line through D and C. The weight of the rider acts vertically downwardly at point E for the case of a conventional skeateboard where the rider's feet are on the deck 30. Where the rider's feet are are below the level of deck 30 at the level of point F as in the present case, the tipping moment is the product of the horizontal displacement from point F to point G, namely 'y', and the weight of the rider, which now acts vertically through point G. Clearly, with the rider's feet positioned close to point C, the tipping torque is low as compared with a more distant position as at point D.

This raising of the rider's feet as he tips gives the rider a feeling similar to the one he experiences on a snowboard. The swinging effect of the ramp board is a result of the fact that the rider's feet are supported by a surface that is below a level of a pivot point of the trucks. It is also due to the fact that the truck and wheel assemblies are outside of the rider's feet rather than below. This positioning gives the rider a feeling similar to the one he experiences on a snowboard.

Accordingly, while this invention has been described with reference to illustrative embodiments, this description is not intended to be construed in a limiting sense. Various modifications of the illustrative embodiments, as well as other embodiments of the invention, will be apparent to persons skilled in the art upon reference to this description. It is therefore contemplated that the appended claims will cover any such modifications or embodiments as fall within the true scope of the invention.

I claim:

1. A skateboard, comprising:

(a) a deck having an arch along its length with sufficient curvature to provide a resilient response and having a center elevated more than its ends;

(b) two bumpers, one at either end of said deck, each of said bumpers extending above and rigidly affixed to said deck; and (c) truck and wheel assemblies mounted beneath respective ones of said bumpers; and (d) a frame having a bottom surface below said deck extending from one end thereof below an axis of said wheels to another end thereof below an axis of said wheels.

2. A skateboard according to claim 1, including foot supports formed on top of said deck inside of said bumpers, such that a distance between said wheel assemblies is greater than a distance between said foot supports.

3. A skateboard according to claim 2, wherein said foot supports are at a level below a pivot of said trucks.

4. A skateboard according to claim 2, including a pair of bindings, one binding over each one of said foot supports.

5. A skateboard according to claim 2, wherein said foot supports are flat.

6. A skateboard according to claim 1, wherein said frame has a U-shape.

7. A skateboard according to claim 1, wherein said bumpers each have a vertical section which extends above said deck and a horizontal section which extends outwardly from and substantially perpendicular to said vertical section.

8. A skateboard according to claim 7, including gusset supports between said vertical and horizontal sections of said bumpers.

9. A skateboard according to claim 7, wherein said horizontal sections have a width narrower than a width of said deck in order to fit between said wheels.

10. A skateboard according to claim 1, wherein said bumpers have a central recess on an outer edge of a horizontally extending portion thereof to allow said bumpers to fit over a rail during a nose stand.

* * * * *